United States Patent [19]

Heemstra

[11] Patent Number: 4,512,424

[45] Date of Patent: Apr. 23, 1985

[54] TUBULAR SPRING SLIP-JOINT AND JAR

[75] Inventor: Timothy R. Heemstra, Duncan, Okla.

[73] Assignee: Halliburton Company, Duncan, Okla.

[21] Appl. No.: 564,820

[22] Filed: Dec. 22, 1983

[51] Int. Cl.[3] ..... E21B 17/07

[52] U.S. Cl. ..... 175/299; 175/321; 166/178; 464/21

[58] Field of Search ..... 175/299, 300, 320, 321, 175/324, 293; 166/178, 242; 464/19-21, 169, 180, 182; 267/69; 141/388

[56] References Cited

U.S. PATENT DOCUMENTS

| | | | |
|---|---|---|---|
| 3,189,098 | 6/1965 | Haeber | 166/346 |
| 3,254,508 | 6/1966 | Garrett | 175/321 |
| 3,447,340 | 6/1969 | Garrett | 175/321 |
| 3,461,916 | 8/1969 | Ledgerwood, Jr. | 141/388 |
| 3,913,668 | 10/1975 | Todd et al. | 166/346 |
| 4,067,202 | 1/1978 | Reed | 61/86 |

FOREIGN PATENT DOCUMENTS

| | | | |
|---|---|---|---|
| 395562 | 12/1973 | U.S.S.R. | 175/321 |

*Primary Examiner*—James A. Leppink
*Assistant Examiner*—Hoang C. Dang
*Attorney, Agent, or Firm*—Joseph A. Walkowski; Thomas R. Weaver

[57] ABSTRACT

The present invention comprises a pressure balanced tubular spring slip-joint and jar including a generally tubular outer housing having longitudinal slot means in the wall thereof, and a hammer area of increased wall thickness at one end thereof, within which housing slidably extends a jar mandrel means having first and second longitudinally spaced enlarged diameter anvil areas, at least one fastener tapped into one of those anvil areas, the heads of said fastener protruding into said slot means. Both said housing and said mandrel means possesses axial bores therethrough, which are placed in communication via the bore of a tubular spring within the housing, whereby during extension and contraction of the slip-joint and jar means of the present invention the area within said axial bores and said spring bore is of a constant volume. The invention may be employed to provide force impulses in either longitudinal direction, said tubular spring aiding the application of those impulses when said housing and said mandrel means move relatively toward each other. By proper selection of spring length and use of a coiled spring having spaced coils, the present invention may also be employed as a bi-directional shock absorber.

19 Claims, 7 Drawing Figures

TUBULAR SPRING SLIP-JOINT AND JAR

BACKGROUND OF THE INVENTION

This invention relates generally to an improvement in downhole tools and to methods of using the same. This invention relates more particularly, but not by way of limitation, to a pressure balanced tubular spring slip-joint and jar which eliminates the need for conventional telescoping slip-joints with sliding seals.

In drilling and testing a well, downhole tools are used to monitor downhole conditions, such as temperature and pressure, to obtain information which is helpful in evaluating the nature of the well, such as whether the well is likely to produce hydrocarbons. One particular condition which is preferably monitored is reservoir pressure measured over periods of time during which the well is alternately allowed to flow and prevented from flowing. This condition may be determined by means of a drill stem test which can be conducted utilizing techniques known in the art.

One such technique using an improved downhole tool for drill stem testing is described in copending U.S. application Ser. No. 480,981, assigned to the assignee of the present application and hereby incorporated herein by reference. The downhole tool disclosed in the aforesaid copending application is constructed to be utilized without the need of any downhole electrical controls in placing the tool in an operating position in a well, in removing it therefrom, or in mechanically opening and closing a valve of the tool. The tool also includes jarring means for assisting in the mechanical implacement and extraction of the tool, and is also constructed so that it is of a size which makes it relatively easy to transport and handle. The preferred embodiment of the tool is particularly constructed to sense reservoir pressures and provide electrical signals to the surface for generating real-time readouts of the pressure magnitudes, and includes a relatively easily removable protective housing for containing a sensor which senses the desired downhole condition.

The method of using the aforesaid tool broadly includes lowering the probe part of the tool into the well on a cable whose movement is controlled by a suitable hoist means located at the surface of the well. The probe is lowered into the well until a connector thereon suitably engages protuberances of slide means on the portion of the tool incorporated in the tool string. The cable is then withdrawn from the well to raise the probe so that the connector locks with the protuberances whereby further lifting of the probe moves the slide means upward against biasing means to the tool-actuated position. Once the tool has performed its function in the tool-actuated position, the cable is lowered so that the probe descends into the well whereby the connector unlocks from the protuberances. The cable is then raised so that the probe is lifted out of the well. To assist in the engagement or removal of the connector and the protuberances, the cable can be raised a short distance to activate the jarring means and then released to allow the jarring means to slam into the housing with a force impulse. The jarring means can also be used so that the force impulse is applied by a quick upward movement of, rather than a release of, the cable.

While this tool is an improvement over the prior art, it suffers from several major disadvantages. First, with the sensor device located in the bottom portion of the probe, lengthy electrical conductors with several connections are required to connect the sensor device to the wireline head at the top of the tool, increasing the possibility of data transmission failure. Furthermore, the location of the sensor device in the bottom of the probe makes it very vulnerable to the shocks the probe may encounter on its trip down the well bore, and makes it and its attendant electrical part of the connections an integral part of the jarring means, again contributing to the possibility of electrical failure due to the lengthy conductors and multiple connectors employed. In addition, the location of the sensor device in the probe makes disassembly thereof necessary for sensor device replacement. Finally, locating the sensor device within the lower portion of the probe reduces the force which can be applied in a downward direction by the jarring means, without the addition of sinker bars or other weighting means to the wireline head, making the probe much more difficult to handle and placing greater strain on the wireline.

SUMMARY OF THE INVENTION

The pressure balanced tubular spring slip-joint and jar of the present invention overcomes the aforementioned disadvantages of the prior art downhole tool described above, and possesses significant additional advantages over prior art pressure-balanced jars in general. The pressure balanced tubular spring slip-joint and jar of the present invention comprises a generally tubular outer housing having at least one longitudinal slot in the wall thereof, and a hammer area of increased wall thickness at one end thereof. Slidable within the housing is a jar mandrel means having a first enlarged diameter anvil area at one end thereof of slightly lesser outer diameter than the inner diameter of the housing. One or more screws are tapped into this first enlarged diameter end of the jar mandrel means, the heads of which extend into the aforesaid one or more housing slots. At the other end of the jar mandrel means is another second enlarged diameter anvil area. The hammer is reciprocable between the two enlarged diameter ends of the jar mandrel means. At the top of the outer housing is a plug having an axial bore therethrough, the jar mandrel means also possessing an axial bore therethrough. These two bores are placed in communication via a tubular coiled spring, which spring permits the reciprocation and thus extension and contraction of the housing and jar mandrel means while maintaining a constant volume within the two axial bores and the spring. Thus, unlike prior art slip joints and pressure balanced jars, the present invention does not require the bulk of annular chambers, does not experience the relatively high sliding frictional forces of the telescoping prior art slip-joints and jars and is not subject to seal deterioration and failure. Moreover, the slip-joint and jar of the present invention can be built very compactly, and is therefore suitable for wireline and slick line applications, where the bulk of a prior art slip-joint or jar would be unacceptable. This compactness and very small O.D. also permits the use of the present invention in tight casing or small diameter pipe strings.

The present invention is also adapted to use as a bidirectional shock absorber, by use of a coiled spring having longitudinally spaced coils in the relaxed state of the spring, through resistance to relative longitudinal movement of the housing and jar mandrel means when the spring is placed either under compression or tension.

BRIEF DESCRIPTION OF THE DRAWINGS

The present invention will be more fully understood by reference to the following detailed description of the preferred embodiment, in conjunction with the accompanying drawings, wherein.

DETAILED DESCRIPTION AND OPERATION OF THE PREFERRED EMBODIMENT

Figure 1A:
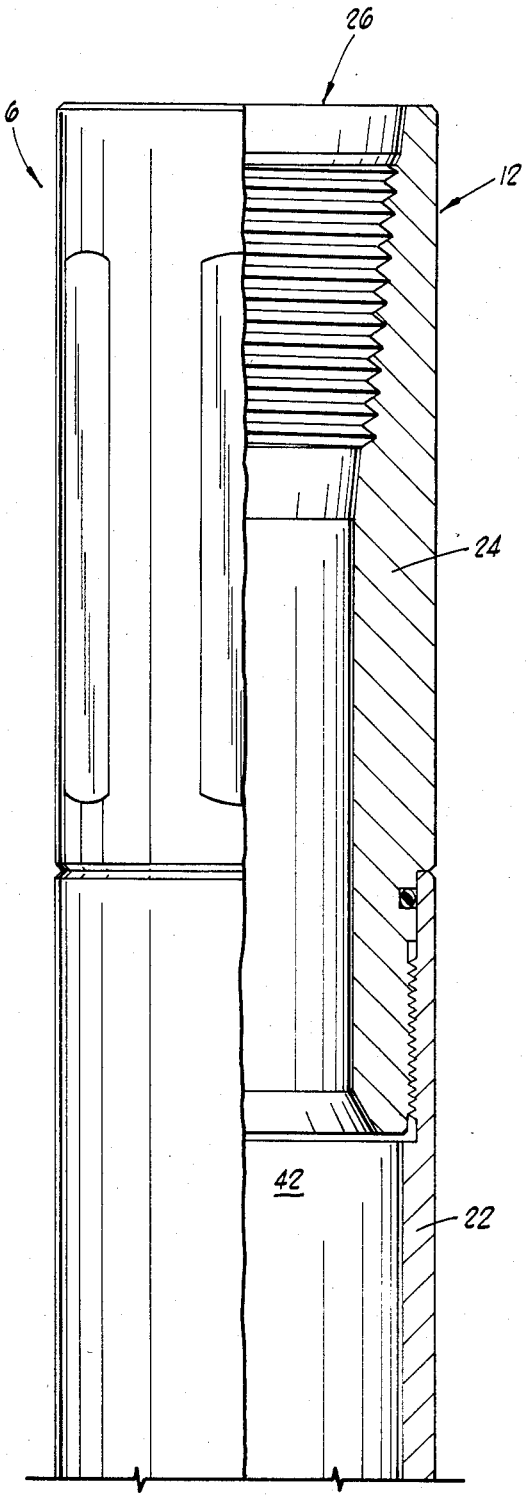
FIGS. 1A–1E form a partially sectioned elevational view of a downhole tool constructed in accordance with a preferred embodiment of the present invention.

With reference to the drawings, a tool similar to that disclosed in the aforesaid U.S. application Ser. No. 480,981 constructed in accordance with a preferred embodiment of the present invention will be described. As illustrated in FIG. 3, the tool includes a pipe string portion 2 and probe portion 4 having at least one sensor device in gauge housing 5 at the top thereof. The preferred embodiment of these two portions will be described with reference to FIGS. 1A–2.

The pipe string portion 2 of the tool is shown in FIGS. 1A–1E to broadly include support means 6 for supporting the tool in a well, slide means 8 (FIGS. 1C–1D) disposed in sliding relationship with the support means 6, the biasing means 10 (FIG. 1C) for biasing the slide means 8 toward a tool-unactuated position, which tool-unactuated position is that position in which the slide means 8 is shown in the drawings. The support means 6 has a top end 12 (FIG. 1A) and a bottom end 14 (FIG. 1E), which top end 12 is disposed closer than the bottom end to the top of the well when the support means 6 is disposed in the well. In the preferred embodiment, the slide means 8 is supported by the support means 6 at a position which is closer to the bottom end 14 than is the position at which the biasing means 10 is retained in the support means 6.

It is to be noted that as used herein, the words "top," "upward" and the like define positions or directions of elements which are relatively higher, as viewed in the drawings hereof or with reference to the top or mouth of the well, than are associated elements identified as "bottom," "downward" and the like.

In the tool the support means 6 is a substantially cylindrical structure comprising several elements as illustrated in the drawings. These elements are arranged in an outer structure and an inner structure. The outer structure functions as a container means for holding the inner structure and for holding the pressure, and it also functions as the means by which the tool is connected into a pipe or tubing string or other structure by means of which the pipe string portion 2 is retained in the well. It is to be noted that as used in the specification and claims hereof, "pipe string" is to mean that structure by which the pipe string portion 2 is held in the well, whether that structure is actually known in the art as a pipe string, a drill string, a tubing string, or other type of structure.

Figure 1B:
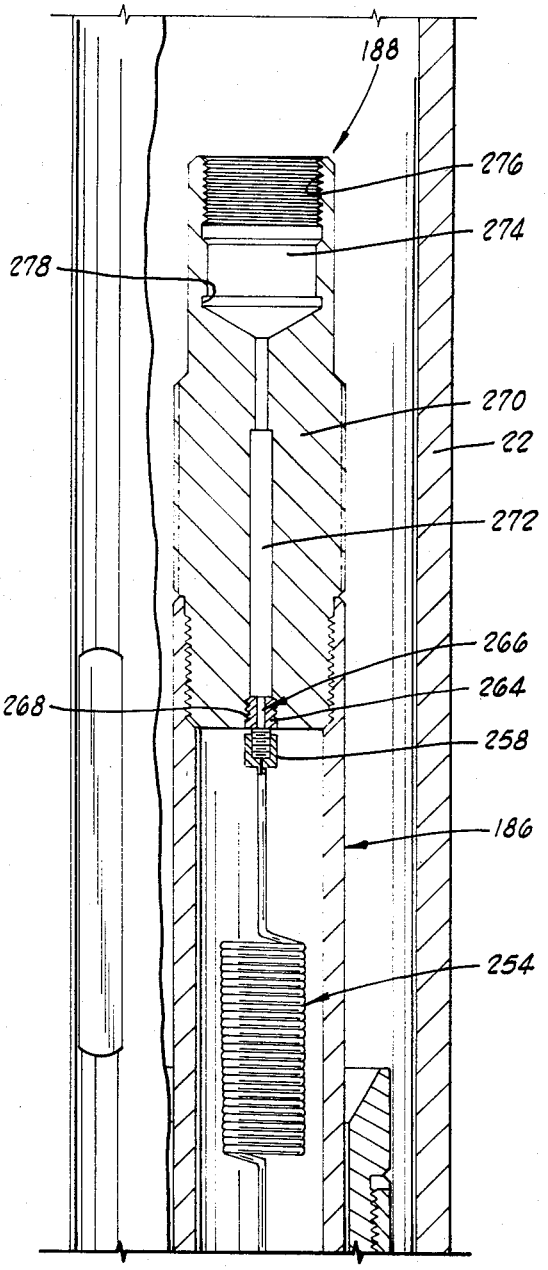
Figure 1C:
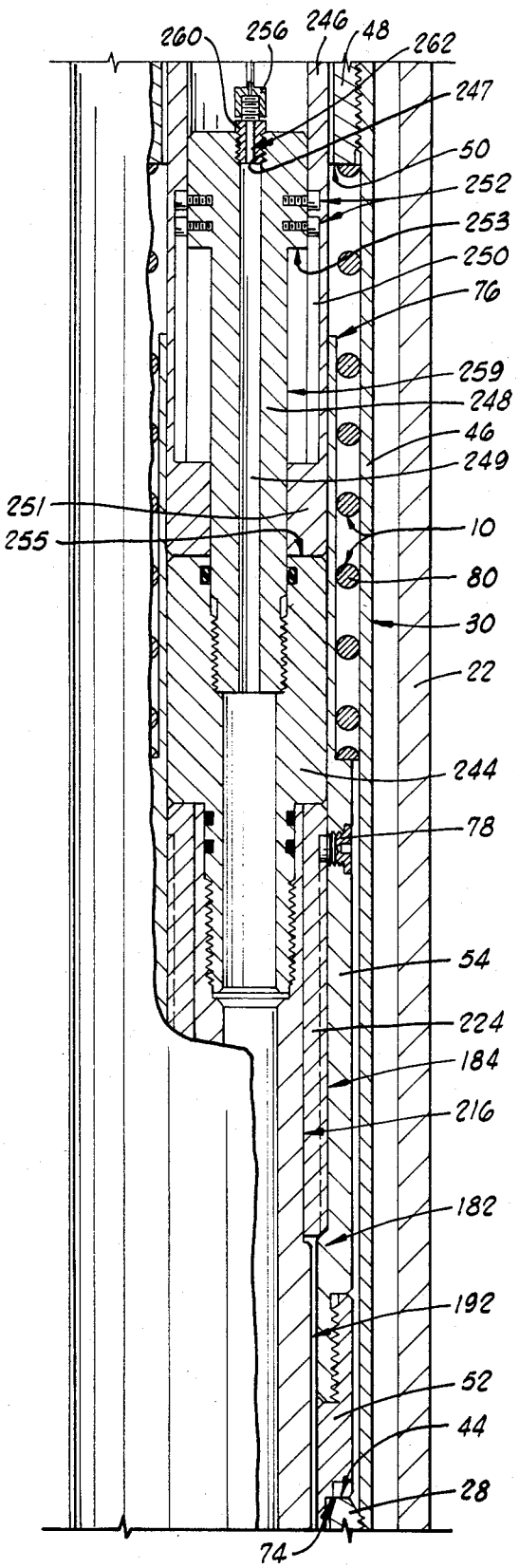
Figure 1D:
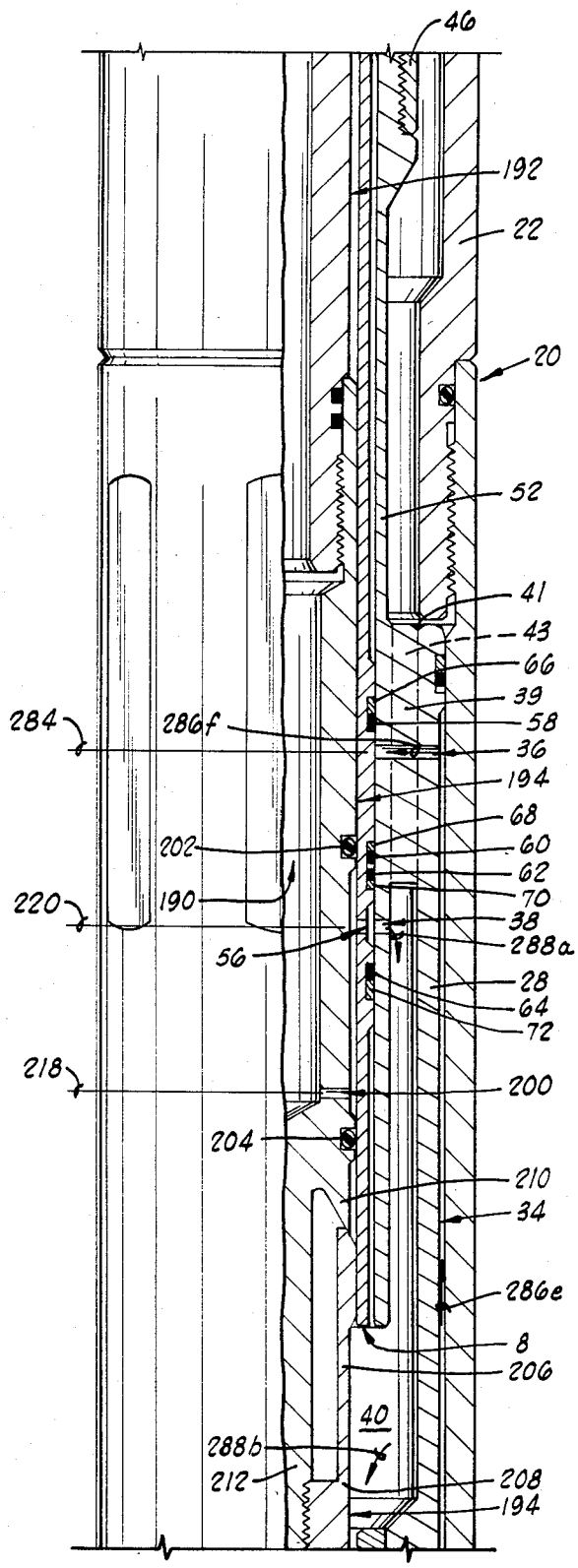

The outer structure, or container means, of the tool includes a cylindrical valve case 16 having a bottom end 18 and a top end 20. The bottom end 18 is connectable with a tester valve as will be subsequently described. The top end 20 is shown in FIG. 1D to be threadedly and fluid-tightly connected to a first end of a housing case 22 forming another part of the container means. The housing case 22 includes a second end which is shown in FIG. 1A to be threadedly and fluid-tightly connected to a top adapter member 24 having a threaded box end 26 for coupling with a threaded pin end of a pipe (not shown).

Figure 1E:
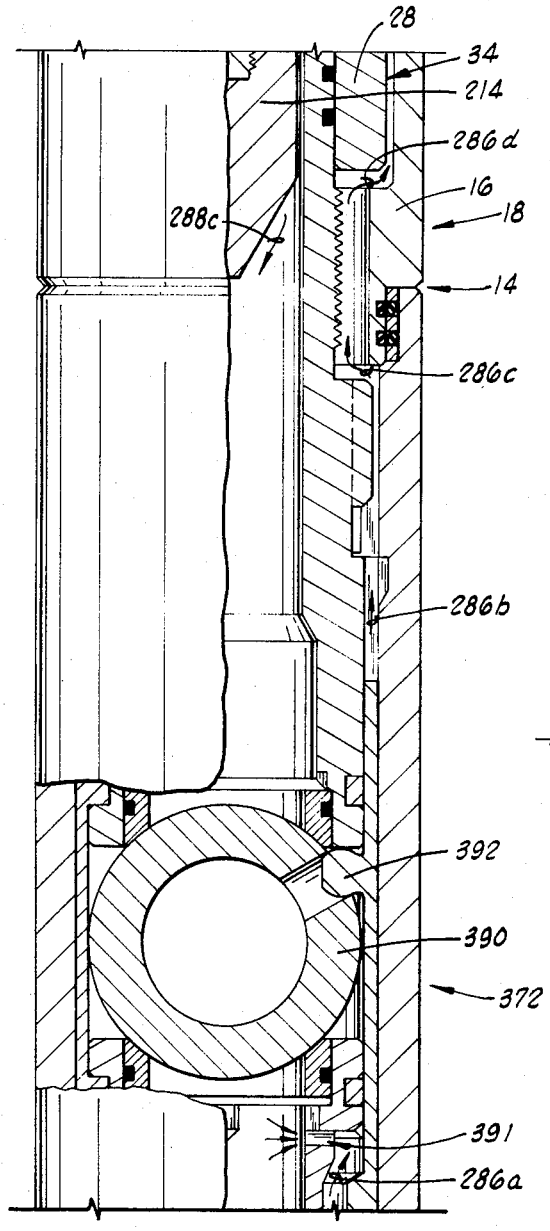

The inner structure which is contained within the outer structure includes a valve body 28 and retainer means 30 for retaining the biasing means 10. The valve body 28 is shown in FIGS. 1C–1E, and the retainer means 30 is shown in FIGS. 1B–1D.

The valve body 28 has a relief area 34 defining a space between the valve case 16 and the valve body 28. Reservoir or well fluid, and thus reservoir or well pressure, is always present in the region defined by the relief area 34 when the pipe string portion 2 is disposed in the well. The region defined by the relief area 34 communicates with at least one port or opening 36 defined laterally through the valve body 28 whereby the reservoir or well pressure is also present in the port 36.

The valve body 28 includes another port 38 which communicates with a cavity 40 defined in the valve body 28 as shown in FIG. 1D. The cavity 40 opens into a hollow interior portion 42 of the pipe string portion 2.

The valve body 28 also includes spiders 39 welded, as at a weld 41, into the main portion of the valve 28. The spiders 39 are spaced from each other so that openings 43 are defined therebetween. These openings 43 permit borehole fluid to flow to the surface along the passageway shown in FIGS. 1B–1D to be defined between the housing case 22 and the retainer means 30, through the adapter member 24, and through the pipe string in which the pipe string portion 2 is disposed.

The valve body 28 further includes stop means for defining a first limit of travel which limits the distance the slide means 8 can move in the downward direction. The stop means includes a shoulder 44 defined at the top of the valve body 28. The shoulder 44 extends inwardly of the retainer means 30 which is connected to the valve body 28. "Inwardly" and the like refer to a direction or position relatively closer to the longitudinal axis of the tool.

The retainer means 30 includes an elongated member 46 having the biasing means 10 retained therein for engagement with the slide means 8. The retainer means 30 also includes a cap 48 threadedly connected to the top end of the elongated member 46. The cap 48 provides a shoulder 50 which functions as a stop means for defining a limit of travel of the slide means 8 in the upward direction. The cap 48 also defines a barrier against which an upwardly acting force acts in opposition to the biasing force provided by the biasing means 10.

As shown in FIGS. 1C–1E, the valve body 28 is primarily disposed within the valve case 16 so that there is little if any relative movement between the valve case 16 and the valve body 28 in a longitudinal direction. FIGS. 1B–1D disclose that the retainer means 30 is disposed within the housing case 22. These elements are substantially cylindrical with hollow interiors in which the slide means 8 and the biasing means 10 are disposed.

As shown in FIGS. 1C–1D, the slide means 8 includes a sliding sleeve valve comprising a valve member 52 and an extension member 54. The valve member 52 is slidable adjacent the valve body 28, and the extension member 54 is slidable, simultaneously with the valve member 52, adjacent the elongated member 46.

The valve member 52 has at least one port 56 defined therethrough. The valve member 52 is disposed within the pipe string portion 2 so that the port 56 can be positioned along the valve body 28 between a position at which the port 56 is substantially aligned in fluid communication with the port 36 and a position spaced from a port 36, which position is the location of a port 38. To maintain the port 56 fluid-tightly sealed with whichever of the ports 36 or 38 it is in fluid communication, and to fluid-tightly seal the port 56 from the other of such ports 36 or 38 with which it is not then in fluid communication, the valve member 52 has O-rings 58, 60, 62, 64 and Teflon backup rings 66, 68, 70 and 72 associated therewith as shown in FIG. 1D.

To properly position the valve member 52 and the port 56 relative to the ports 36 and 38, the valve member 52 further includes means for cooperating with the stop means defined by the shoulder 44 and means for cooperating with the other stop means defined by the shoulder 50. The means for cooperating with the shoulder 44 is defined by a shoulder 74 which is an outwardly extending flange that engages the shoulder 44 to limit the downward movement of the valve member 52 in response to the biasing force exerted by the biasing means 10. The stop means which cooperates with the shoulder 50 is defined by another shoulder 76 defined by an upper end of the extension member 54. The shoulder 76 engages the shoulder 50 to limit the upward movement of the valve member 52 in response to an opposing force oppositely directed to and greater than, the force exerted by the biasing means 10. When the shoulder 74 engages the shoulder 44, the ports 38 and 56 are in fluid communication, and when the shoulder 76 engages the shoulder 50, the ports 36 and 56 are in fluid communication.

The extension member 54 provides a biasing means engagement arm for engaging and compressing the biasing means 10 when a sufficient opposing force is applied to the sliding sleeve valve. The extension member 54 also responds to a superior biasing force to move the valve member 52 to its lowermost position wherein the ports 38 and 56 are in fluid communication.

Associated with the extension member 54 is at least one pin 78 which is shown in FIG. 1C to be threadedly connected in an opening defined through the extension member 54. The pin 78 is inwardly directed so that it protrudes as an engagement lug into the hollow interior portion 42 of the pipe string portion 2. This protruding lug engages the probe portion 4, as will be subsequently described, so that the afore-mentioned opposing force can be transmitted to the sliding sleeve valve to overcome the biasing force provided by the biasing means 10.

As shown in FIG. 1C, the biasing means 10 includes a spring 80 retained within the retainer means 30 (alternatively denominated a "spring housing") between the cap 48 and the extension member 54. The spring 80 exerts the aforementioned biasing force against the extension member 54 tending to urge the shoulder 74 into engagement with the shoulder 44. It is this biasing force of the spring 80 which a counterforce applied to the probe portion 4 in engagement with the pin 78 must overcome to move the slide means 8 to a tool-actuated position wherein the port 56 is moved into fluid communication with the port 36.

The probe portion 4 includes mechanical means for moving the slide means 8 from the tool-unactuated position (i.e., the position in which the ports 38 and 56 are in fluid communication) to the tool-actuated position (i.e., the position in which the ports 36 and 56 are in fluid communication) when the aforementioned counterforce, which counterforce is provided by a longitudinal reciprocation of the probe portion 4, is greater than the biasing force exerted by the biasing means 10. The mechanical means of the probe portion 4 includes housing means 182 (FIGS. 1C–1E), connector means 184 (FIG. 1C), and coupling means 188 (FIG. 1B), and the tubular spring slip-joint and jarring means 186 of the present invention.

Unlike the tool disclosed in aforesaid application Ser. No. 480,981, the housing means 182 is used for receiving well fluid under pressure and communicating the pressurized fluid to a pressure sensor located at the top portion 5 of probe portion 4, rather than for receiving a pressure sensor device, as will subsequently be explained in detail. The well fluid is received in a cavity 190 defined within a tubular chamber housing 192 and a nose assembly 194 threadedly and fluid-tightly connected to the housing 192 as shown in FIG. 1D.

Pressure is communicated to cavity 190 via at least one port 200 defined through the wall of the nose assembly 194. The port 200 is maintained in fluid communication with the port 56, but is fluid-tightly sealed from other portions of the tool by means of O-rings 202, 204.

The nose assembly 194 has a plurality of guide fingers 206 pivotally associated therewith for preventing abrasion of O-rings 202 and 204 by contact with the interior of the pipe string. The fingers 206 are biased to pivot in a direction away from the probe portion 4 by suitable biasing means located at the points of connection between the fingers 206 and the nose assembly 194, one of which points of connection is identified in FIG. 1D by the reference numeral 208. To prevent the fingers 206 from extending outwardly an undesirable distance, a retaining ring 210 is provided on the nose assembly 194.

As shown in FIGS. 1D–1E, the nose assembly 194 includes a main body 212 having a conical tip 214 threadedly connected thereto.

Housing 192 includes a substantially cylindrical sleeve element having a recessed region 216 on which the connector means 184 is rotatably disposed. The connector means 184 engages the protruding lug or lugs provided by the one or more pins 78 (subsequently referred to in the singular for convenience) when the probe portion 4 is longitudinally moved into the hollow interior portion 42 of the pipe string portion 2. When this engagement is suitably secured with the protruding lug and the connector means related in a locked position, the sliding sleeve valve can be moved in opposition to the biasing means 10. This locking position is achieved when the probe portion 4 is disposed within the pipe string portion 2 and the ports 56 and 200 are substantially spatially aligned.

Stated differently, the connector means 184 is mounted on the housing 192 for cooperative engagement with the pin 78 for defining a first position and a second position to which the housing means 182 is movable relative to the sliding sleeve valve. The first position is the lowermost position to which the housing means 182 can move relative to the sliding sleeve valve. The second position is the uppermost engaged position to which the housing means 182 can move relative to the sliding sleeve valve when the connector means 184 and the pin 78 are engaged. This second position is also the position of the housing means 182 from which movement of the sliding sleeve valve commences when the aforementioned opposing force greater than the biasing force exerted by the biasing means 10 is applied to the probe portion 4. The ports 56 and 200 are spaced from each other as shown in FIG. 1D when the housing means 182 is in the first position, and the ports 56 and 200 are substantially spatially aligned when the housing means 182 is in the second position. The reference numeral 218 identifies the location of the port 200 in the first position, and the reference numeral 220 identifies the location of the port 200 in the second position. Although having different spatial relationships between the first and second positions, the ports 56 and 200 are always in fluid communication in each of these positions as is apparent from the illustrated spacing of the O-rings 202 and 204.

Figure 2:
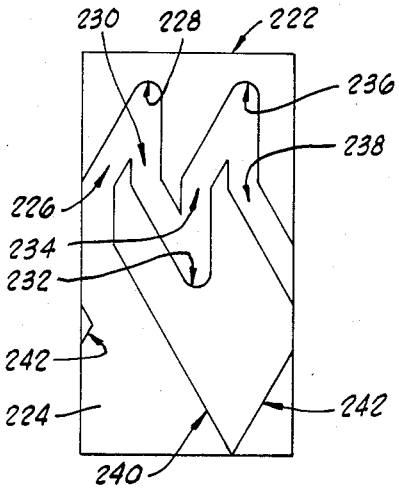
FIG. 2 is a layout view of a J-slot member of the downhole tool shown in FIG. 1C.
Figure 3:
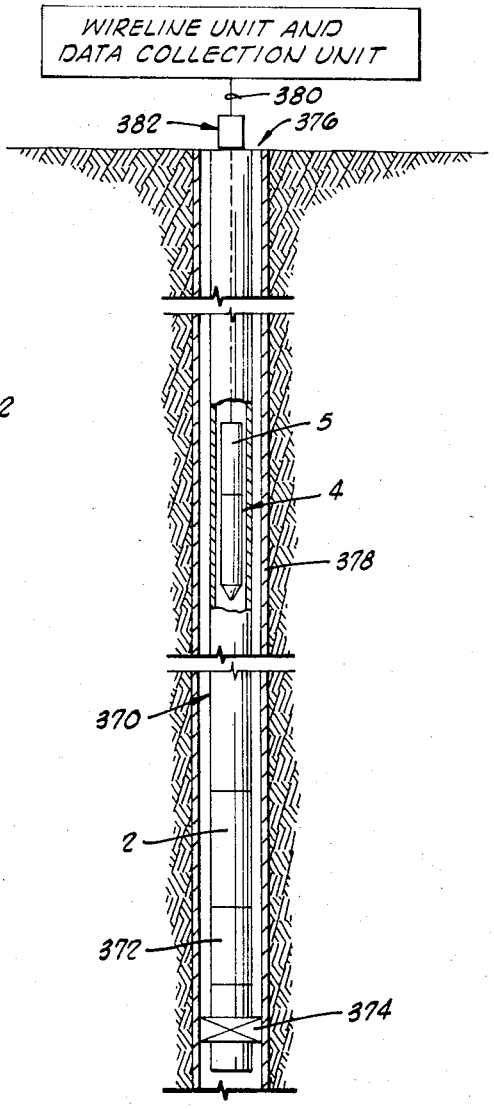
FIG. 3 is a schematic representation of the downhole tool utilizing the present invention associated with a pipe string disposed in a well.

With reference to FIG. 2, connector means 184 will be described. Connector means 184 includes a J-slot member 222 having a collar 224 rotatably mounted on the gauge housing 192 and further having channel means defined in the collar 224. The channel means cooperate with pin 78 so that the positions 218 and 220 are defined and further so that the valve member 52 is moved between the limits of travel defined by the shoulders 44, 74 and 50, 76.

The channel means includes a first channel 226 for receiving and engaging the pin 78 when the probe portion 4 is moved into the pipe string portion 2 a sufficient distance to place the port 200 at the position 218. This distance into which the probe portion 4 can be advanced toward the bottom end of the pipe string portion 2 is limited by an upper wall 228 of the first channel 226.

The channel means also includes a second channel 230 into which the pin 78 moves after it has engaged the wall 228. The second channel 230 receives and engages the pin 78 when the probe portion 4 is moved a distance away from the bottom end of the pipe string portion 2 after having first been moved so that the pin 78 engages the wall 228. The extent to which the probe portion 4 can move relative to the pipe string portion 2 when the pin 78 is in the second channel 230 is limited by a wall portion 232 of the channel 230. When the pin 78 is engaging the wall portion 232, the probe portion 4 is in the locked position relative to the pipe string portion 2. When the probe portion 4 and the pipe string portion 2 are in this locked relationship, the port 200 is at the second position 220 wherein it is substantially spatially aligned with the port 38. From this position, the probe portion 4 can be pulled away farther from the bottom end of the pipe string portion 2 if the pulling force is sufficiently string to overcome the biasing force of the spring 80; if this occurs, then both the probe portion 4 and the slide means 8 move relative to the support means 6 of the pipe string portion 2. This causes the substantially aligned ports 56 and 200 to be moved, in unison, into fluid communication (and, into substantial spatial alignment) with the port 36 so that the fluid pressure present in the port 36 is communicated to cavity 190.

The channel means of the J-slot member 222 further includes a third channel 234 for receiving and engaging the pin 78 when the probe portion 4 is again moved toward the bottom end of the pipe string portion 2 after having been moved to position the pin 78 in the locked position adjacent the wall portion 232. The movement of the pin 78 through the third channel 234 continues until the pin 78 engages a wall portion 236 of the channel 234. When the pin 78 is at the position adjacent the wall portion 236, the port 200 has returned to the position 218 so that the cavity 190 is no longer in fluid communication with the well pressure present in the port 36. During this movement of the pin 78 from the locked position adjacent the wall portion 232 to the wall portion 236, the fluid communication with the port 36 has been broken, the pressure within the cavity 190 has been vented through the ports 200, 56 and 38 and the cavity 40, and the ports 56 and 200 have again become spatially separated.

The channel means also includes a fourth channel 238 for receiving and disengaging the pin 78 when the probe portion 4 is moved away from the bottom end of the pipe string portion 2 after having been moved the aforementioned directions by means of which the pin 78 has traveled through the first, second and third channels.

The channel means also includes lower wall portions 240, 242 which are constructed to direct the pin 78 into the first channel 226 when the probe portion 4 is initially lowered into the pipe string portion 2.

The wall portions 228, 232 and 236 function as lug engagement limiting means for limiting the travel of the lug 78 through the channel means.

It is to be noted that the connector means 184 includes two sections of the collar and channel means shown in FIG. 2 (i.e., FIG. 2 is a layout view of onehalf, or 180°, of the connector means 184). Each of the two sections cooperates with its own respective pin 78 so that the illustrated preferred embodiment includes two pins 78. It is to be further noted, however, that the present invention does not require that two of each of these structures be used; that is, more or less than two can be used.

The connector means 184 is associated with the top portion of housing 192 near a threaded end which is connected to the tubular spring slip-joint and jarring means 186 of the present invention by threads on coupling member 244. The slip-joint and jarring means 186 includes a jar case 246 and a jar mandrel 248, the latter of which is connected to housing 192 through threaded engagement with the coupling member 244, jar mandrel 248 retaining the jar case 246 in sliding relationship with the housing means 182. Jar mandrel 248 includes axial bore 249 therethrough, which bore 249 includes a threaded area 247 at its upper extent. The jar case 246 includes one or more slots 250 through which the heads of a plurality of screws 252 extend from the jar mandrel 248 for permitting the sliding relationship, but for preventing circumferential or torsional movement of the jar case 246 relative to the jar mandrel 248 and housing means 182.

The jar case 246 includes a striker block portion 251 located at the lower end of the slot 250. The striker block 251 is movable, as will be subsequently described, between an upper flange 253 of the jar mandrel 248 and a lower flange 255 of the coupling member 244. coupling member 244 and jar mandrel 48 together comprising jar mandrel means 259.

The jar case 246 is a substantially cylindrical, hollow member having a tubular coiled jar spring means 254 disposed therein for conducting pressurized well fluid from axial bore 249, which tubular spring means 254 includes internally threaded connectors 256 and 258 at its ends, connector 256 engaging threads on hollow plug 260 having bore 262 therethrough, hollow plug 260 in turn engaging threads 247 in the upper portion of jar mandrel bore 251. Connector 258 engages threads on hollow plug 264 having bore 266 therethrough, plug 264 in turn engaging threads 268 in the lower portion of axial bore 272 of top coupling member 270. Top coupling member 270 further includes an enlarged bore 274 at its upper end, which bore 274 includes internal threads 276 and O-ring channel 278.

With reference to FIG. 3, a use of the preferred embodiment of the present invention will be described. Initially, the pipe string portion 2 of the downhole tool is made up as a part of a pipe string 370 (which, as previously described, can be a tubing string or other structure which is identified herein under the name "pipe string"). Also forming portions of the pipe string 370 are a tester valve 372 and a packer 374. The tester valve 372 is of any suitable type as known to the art, such as a Halliburton Services APR ®-N tester valve for use in a cased hole or a FUL-FLO ® HYDRO-SPRING tester valve for use in an open hole. The packer 374 is also of a suitable type as known to the art, such as a Halliburton Services RTTS hook wall packer or open hole testing packer.

As shown in FIG. 1E, the tester valve 372 includes a ball valve member 390 actuated by valve actuator arms 392 as known to the art. The tester valve 372 also includes a port 394 for communicating reservoir fluid and pressure to the pipe string portion 2 even when the ball valve member 390 is closed.

The pipe string 370 in FIG. 3 is disposed in a well 376 having a casing 378 disposed therein by way of example and not by way of limitation, as the tool can be employed in an open hole. The packer 374 is set as known to the art. With this installation completed, the probe portion 4 of the tool can be lowered into the pipe string 370 for engagement with the pipe string portion 2 of the tool so that drill stem tests, for example, can be conducted.

The probe portion 4 is moved into and out of the well 176 on a wireline cable 380 which is part of a wireline unit of a type as known to the art. Movement of the wireline cable 380 is by suitable hoist means included in the wireline unit as known to the art.

Associated with the wireline unit, as shown in FIG. 3, is a data collection system of a type as known to the art for retrieving and processing the electrical information received from the probe portion 4 via the wireline cable 380. In an embodiment of a suitable data collection system known to the art, pressure versus time plots can be developed and the well's productivity, static reservoir pressure, transmissibility, actual flow capacity, permeability, and formation damage can be calculated, plotted and printed at the well site. The data collection system also includes means for displaying the real-time pressure readings taken by the preferred embodiment of the present invention.

For this utilization schematically illustrated in FIG. 3, the probe unit 4 is placed into the well 376 through pressure control equipment 382 of a type as known to the art. The pressure control equipment 382 includes a pressure control unit, a wireline blowout preventor valve, and a lubricator stack, all of types as known to the art. The pressure control unit provides hydraulic pressure to the wireline blowout preventor valve, the lubricator stack and the wireline unit. The pressure control unit also supplies grease, injected under pressure, methanol injection and a pneumatic supply to the lubricator stack.

The wireline blowout preventor valve is used in conjunction with the lubricator stack when operations under pressure are to be performed. This valve is hydraulically operated and controlled by the pressure control unit.

The lubricator stack provides a means for installing the probe portion 4 in preparation of its running into the well while the well 376 is under pressure. With the probe portion 4 so installed, the wellhead valve is opened to allow its entry into the wellbore as known to the art.

With reference to all the drawings, a more particular description of the method of using the present invention will be provided.

The method of the preferred embodiment includes the steps of disposing the pipe string portion 2 into the well 376 so that the valve means of the pipe string portion 2 is located downhole in association with the tester valve 372.

The probe portion 4 is connected with the wireline cable 380 and inserted into the well 376 through the pressure control equipment 382. The hoist means of the wireline unit is actuated to unreel the wireline cable 380, thereby lowering the probe portion 4 into the well toward the pipe string portion 2. This lowering is continued until the pin 78 is guided by either the wall portion 240 or the wall portion 242 into the first channel 226 and into engagement with the wall portion 228. At this position, the ports 36, 38, 56 and 200 are disposed as shown in FIG. 1D. In this position, the probe portion 4 is unable to be lowered any farther into the well 376.

Next, the hoist means is actuated to reel in the wireline cable 380 so that the probe portion 4 is moved upwardly relative to the pipe string portion 2. This movement causes the pin 78 to travel through the second channel 230 into the locked position adjacent the wall portion 232. Once this step has been performed, the port 200 has come into substantial spatial alignment with the port 56, or in other words, has moved to the position 220.

With the pin 78 locked against the wall portion 232, the hoist means is further actuated to tension the wireline cable 380 with a force which is greater than the biasing force exerted by the spring 80. In the preferred embodiment, this force is approximately 600 pounds. When this force is applied by the hoist means to the wireline 380, the probe portion 4 continues to be lifted and the wall portion 232 acts against the pin 78 to move the sliding sleeve valve upward against the spring 80. This upward movement can be continued until the shoulder 76 engages the shoulder 50. When the shoulder 76 engages the shoulder 50, the ports 56 and 200, which ports have been maintained in substantial spatial alignment through the locking engagement of the pin 78 and the wall portion 232, are moved into substantial spatial alignment and, more generally, fluid communication with the port 36. This positioning is indicated by the line in FIG. 1D identified with the reference numeral 284. In this position, the fluid pressure which is present in the port 36 is communicated to the cavity 190, then through jar mandrel bore 249 and tubular jar spring means 254 to top coupling member 270, to which is secured gauge housing 5 (not shown in FIG. 1B) within which is disposed one or more sensor devices which sense the communicated well pressure. A preferred pressure sensor device is a Geophysical Research Corporation 512H pressure and temperature gauge, which is relatively compact so as to minimize the overall size of probe portion 4. However, other instruments can also be used, such as multi-channel devices, sensor devices having memory for retaining the detected information downhole until probe portion 4 is extracted from the well, and other devices. That the pressure from the well is present in the port 36 is indicated by the pressure and fluid flow path identified by the arrows labeled with the reference numerals 286*a*–286*f*.

With the ports 36, 56 and 200 at the position 284, the tester valve 372 is actuated several times to perform a drill stem test as known in the art. The pressures resulting from the drill stem test are detected by the pressure sensor device contained in the gauge housing 5 at the upper end of probe portion 4. The detected pressures are converted into corresponding electrical signals which are transmitted to the surface over the wireline cable 380. Although it is preferred that the electrical signals are communicated to the surface for providing a real-time surface readout via the data collection system, the tool is also contemplated for use with a slick line and detector devices which have self-contained electrical power sources and memories for retaining data correspsonding to the detected pressures, temperatures and other parameters until after the probe unit 4 is extracted from the well. Furthermore, the broad aspects of the tool incorporating the present invention can also be used with other devices, both electrical and non-electrical, which may detect parameters other than pressure in a downhole environment.

Once the testing has been conducted with the illustrated preferred embodiment, the tester valve 372 is closed and the tension is released from the wireline cable 380 so that the probe unit 4 is lowered relative to the pipe string portion 2. This lowering continues until the pin 78 engages the wall portion 236 of the third channel of the connector means 184. When this engagement occurs, the ports 56 and 200 are returned to their positions as shown in FIG. 1D. As the pin 78 moves through the third channel 234 toward the wall portion 236 and the ports 56 and 200 return to their positions as shown in FIG. 1D, the pressure from the cavity 90 of the housing means 83 is vented through the ports 38, 56 and 200 which are maintained in fluid communication. This pressure venting occurs along the path identified by the arrows labeled with the reference numerals 288*a*–288*c*. This pressure relieving operation is important because it relieves the pressure on the O-rings 202 and 204 so that the probe portion 4 can be more easily removed from the well.

Once the pin 78 has moved to its position adjacent the wall portion 236 and the pressure has been relieved from the O-rings 202 and 204, the hoist means is actuated to reel in the wireline cable 380 so that the probe unit 4 is withdrawn from its association with the pipe string portion 2 and the well 376. This disengagement is initiated with the relative movement of the pin 78 along the fourth channel 238 of the connector means 84.

The coupling and decoupling of the connector means 84 and the pin 78 generally achieved by the longitudinal reciprocating movement of the wireline cable 380 can be facilitated by using the tubular spring jarring means 186 of the present invention. If the coupling between the connector means 84 and the pin 78 is stuck and the probe portion 4 needs to be moved down into the well farther, the wireline cable 380 can be withdrawn so that the jar case 246 is positioned with the striker block 251 adjacent the upper flange 253 of the jar mandrel 248. With the striker block 251 so positioned, the wireline cable 380 can be released so that the striker block 251 and portions connected thereto move rapidly downwardly to apply a force impulse to the lower flange 255 of the jar mandrel means 259. Unlike the probe disclosed in Ser. No. 480,981, however, the downward force impulse is not solely dependent upon the weight of the top portion of the probe, but is augmented by tubular spring 254, which is extended prior to release of wireline cable 380. If the connection between the connector means 84 and the pin 78 is stuck and the probe portion 4 needs to be moved in an upward direction, the aforementioned procedure can be reversed wherein the striker block 251 is positioned adjacent the flange 255 as shown in FIG. 1A and then moved rapidly upwardly by rapid intake of the wireline cable 380 on the hoist means so that the striker block 251 applies a force impulse to the upper flange 253 of the jar mandrel 248.

It should be noted that, whether an upward or downward force impulse is required, the slip-joint and jar of the present invention provides a constant volume for well fluid inside tubular spring 254. Moreover, the frictional forces opposing relative longitudinal movement of jar case 246 and jar mandrel means 259 are insignificant in comparison to a jar utilizing a telescoping type slip-joint having O-ring seals. In fact, such a prior art slip-joint would most likely render the connecting and disconnecting means of probe 4 inoperative. Furthermore, the use of the slip-joint and jar of the present invention allows the placement of sensor devices in the top of the probe, wherein they are less susceptible to shocks induced by the striking of probe 4 against portions of the pipe string, the tubular spring 254 acting as a shock absorber as it is partially extended during the probe's travel and connection to pipe string portion 2 of the tool.

Although the preferred embodiment discloses a contracted coiled tubular spring having coils proximate one another tending to pull the housing and mandrel means together, it is also within the contemplation of the present invention to employ a spring having longitudinally spaced coils, so that the spring is partially extended in its untensioned or uncompressed state. In such an embodiment, by proper choice of spring length, the spring would resist relative movement by the housing and mandrel means toward each other by resistance to spring compression, and relative movement of the housing and mandrel means away from each other by resistance to spring tension. In such an embodiment, the invention would act as a shock absorber in both directions, not only when the spring is placed in tension as in the preferred embodiment. Such an embodiment would have utility in cushioning relatively delicate electronic devices employed to record various downhole parameters, such as pressure, temperature, etc. against shocks in both upward and downward directions as a probe carrying such devices is lowered into a well.

From the foregoing it is apparent that the present invention provides a novel and unobvious pressure balanced tubular spring jar possession many advantages over the prior art, including small size, simplicity of manufacture, elimination of elastomeric seals and their attendant friction and propensity to failure.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

I claim:

1. A pressure-balanced slip joint, comprising: generally tubular housing means; coupling means at one end of said housing means and having a longitudinal bore extending therethrough;

mandrel means slidably disposed within said housing means and having a longitudinal bore extending therethrough; and tubular spring means having a substantially constant interior volume disposed in said housing means between said coupling means and said mandrel means, one end of said tubular spring means being secured to said coupling means and the other end to said mandrel means, said coupling means bore communicating with said mandrel means bore through said tubular spring means.

2. The apparatus of claim 1, further including spline means adapted to prevent relative rotation between said housing means and said mandrel means.

3. The apparatus of claim 2, wherein said spline means includes slot means in the wall of said housing means, and lug means protruding from said mandrel means into said slot means.

4. The apparatus of claim 1, further including hammer means and cooperating anvil means associated with said housing means and mandrel means, said hammer means and anvil means adapted to impart a jarring force to said slip joint upon relative longitudinal movement between said housing means and said anvil means.

5. The apparatus of claim 4, wherein said hammer means is associated with said housing, and said anvil means comprises first and second anvils associated with said mandrel means, said hammer being disposed longitudinally between said first and second anvils.

6. The apparatus of claim 5, wherein said hammer means comprises an area of increased wall thickness on said housing means, and said first and second anvils comprise areas of increased diameter on said mandrel means.

7. The apparatus of claim 1, wherein said tubular spring means comprises a coiled spring.

8. A pressure-balanced jar, comprising:

generally tubular housing means;

coupling means at one end of said housing means and having a longitudinal bore therethrough;

mandrel means slidably disposed within said housing means and having a longitudinal bore therethrough, said mandrel means having first and second longitudinally spaced anvil means associated therewith;

hammer means secured to said housing means and disposed between said first and second anvil means;

tubular spring means having a substantially constant interior volume disposed within said housing means between said coupling means and said mandrel means, one end of said tubular spring means being secured to said coupling means and the other end to said mandrel means, said coupling means bore communicating with said mandrel means bore through said tubular spring means.

9. The apparatus of claim 8, wherein said hammer means comprises an area of increased wall thickness on said housing means, and said first and anvil means comprise areas of increased diameter on said mandrel means.

10. The apparatus of claim 8, further including spline means adapted to prevent relative rotation between said housing means and said mandrel means.

11. The apparatus of claim 10, wherein said spline means comprises longitudinal slot means in said housing, and lug means extending radially outward from said first anvil means into said slot means.

12. The apparatus of claim 8, wherein said tubular spring means comprises a coiled spring.

13. The apparatus of claim 12, wherein said coiled spring is adapted to pull said housing means and said mandrel means relatively toward each other when said hammer means and said second anvil means are longitudinally separated.

14. A pressure-balance shock absorber, comprising:

generally tubular housing means;

coupling means at one end of said housing means and having a longitudinal bore extending therethrough;

mandrel means slidably disposed within said housing means and having a longitudinal bore extending therethrough;

tubular spring means having a substantially constant interior volume disposed in said housing means between said coupling means and said mandrel means, one end of said tubular spring means being secured to said coupling means and the other end to said mandrel means, said coupling means bore communicating with said mandrel means bore through said tubular spring means.

15. The apparatus of claim 14, wherein said tubular spring means comprises a coiled tubular spring, the coils thereof being longitudinally spaced in the relaxed state of said spring, being thereby adapted to resist relative movement of said housing means and said mandrel means toward each other when said spring is compressed, and to resist relative movement of said housing means and said mandrel means away from each other when said spring is tensioned.

16. The apparatus of claim 14, further including hammer means and cooperating anvil means associated with said housing means and mandrel means, said hammer means and anvil means adapted to impart a jarring force to said shock absorber upon relative longitudinal movement between said housing means and anvil means.

17. The apparatus of claim 16, wherein said hammer means is associated with said housing, and said anvil means comprises first and second anvils associated with said mandrel means, said hammer being disposed longitudinally between said first and second anvils.

18. The apparatus of claim 17, wherein said hammer means comprises an area of increased wall thickness on said housing means, and said first and second anvils comprise areas of increased diameter on said mandrel means.

19. The apparatus of claim 14, wherein said tubular spring means comprises a coiled spring.

* * * * *